US006808094B1

(12) United States Patent
Hogg

(10) Patent No.: US 6,808,094 B1
(45) Date of Patent: Oct. 26, 2004

(54) APPARATUS TO AID PLACEMENT OF BOOTS ON USER'S FOOT

(76) Inventor: Joseph M. Hogg, P.O. Box 211, Kingston, AR (US) 72742-0211

( * ) Notice: Subject to any disclaimer, the term of this patent is extended or adjusted under 35 U.S.C. 154(b) by 0 days.

(21) Appl. No.: 10/313,381

(22) Filed: Dec. 6, 2002

(51) Int. Cl.[7] ..... A47G 25/80
(52) U.S. Cl. ..... 223/114; 223/113
(58) Field of Search ..... 223/114, 119, 223/113, 115, 116, 117, 118; 211/124, 37, 34, 38, 89.01, 123, 208, 59.1; 403/233, 324

(56) References Cited

U.S. PATENT DOCUMENTS 462,380 A * 11/1891 Gruendler ..... 223/111

* cited by examiner

*Primary Examiner*—John J. Calvert
*Assistant Examiner*—James G Smith
(74) *Attorney, Agent, or Firm*—Joseph L. Lemoine, Jr.

(57) ABSTRACT

The apparatus to assist a user thereof to dress themselves with boots having side pull straps which includes a base plate, a pair of uprights extending upwardly therefrom, and a pair of pins projecting rearward, toward the hole of the user, from which pins the boots may be hung, with the leg portion substantially vertical, from said side pull straps. Upwardly included ends of said pins prevent inadvertent slipping of the boots from said pins, but permit easy removal of the boots from the apparatus by slight lifting of the leg and flexion of the knee.

16 Claims, 3 Drawing Sheets

APPARATUS TO AID PLACEMENT OF BOOTS ON USER'S FOOT

This patent application is a newly filed application, which includes the subject of U.S. patent application Ser. No. 06/884,777, filed Aug. 26, 1986, now abandoned, to which application applicant makes no priority claim.

BACKGROUND OF THE INVENTION

1. Field of the Invention

The invention herein disclosed and claimed relates to an apparatus to assist a person to be able to place boots having side pull straps onto their feet, without the necessity of bending at the waist and using the hands, arms and back muscles to "pull" said boots onto their feet. In general the concept of the invention is to firmly suspend the boot in an upright position, with the leg portion thereof held open, permitting the user to "step into" the boot, and after the foot is fully into the boot, be able to facilely remove the now booted foot from the apparatus. While not so limited, the apparatus disclosed and claimed may have particular utility to persons who, because of physical limitations, may be unable to dress themselves with boots of pull-on design.

2. Description of Related Art

Boots are of course well known. In fact in previous years they may have even been more popular than they are today. There are, of course, boots of many designs. For purpose of discussion of the invention herein disclosed, boots may be categorized into two general categories, those that have openable and closable portions (such as boots of laced, buttoned, zipper or snap design) and boots of "slip-on" design.

Boots of slip-on design are frequently equipped with pull straps (sometimes called simply "pulls") attached at or near the top of the upper of the boot. Sometimes the pulls are at the front and back of the boot, sometimes only at the back, or sometimes at the sides of the boot. Particularly when the uppers or foot portion of boots of slip-on design are relatively snug, putting them on the feet can constitute a chore. Typically the wearer will assume a seated position, bend over, grasp the top of the uppers or pulls with his or her fingers, and, while pushing with the leg, use a combination of finger, hand, arm, shoulder and back muscles to pull the boot onto the foot. Such maneuver can require substantial flexibility and strength of the torso, arms, hands, fingers and legs of the wearer. The invention disclosed and claimed herein is directed to putting the boots onto the foot without pulling them on as described above. In general concept it provides an apparatus where boots having side pulls may be firmly suspended with vertically disposed and opened uppers. So disposed the boot may be stepped into, without having to bend at the waist or grasp and pull with the muscles of the fingers, hands, arms and back. Following installation of a boot on the foot using the invention, the design of the invention permits facile disconnection of the boot from the invention.

Other patents disclose apparatus to aid a user to place boots onto his or her feet. For instance, Wheeler, U.S. Pat. No. 28,927, dated Jun. 26, 1860, discloses a bootjack. Wheeler discloses a forked base piece, containing a removable pair of inclined uprights ("standards"), each of which uprights contain a plurality of fixed pins projecting horizontally and forward therefrom (towards the toe of the boot). The straps of a boot having side pulls may be hung by its pulls from said pins and stepped into. Wheeler accommodates boots of differing length uppers by providing a plurality of forward projecting pins disposed at different vertical heights along each upright. Donauer, U.S. Pat. No. 459,680, dated Sep. 15, 1891 discloses a shoe holder and detacher for use with boots having front and rear pull straps. The boots may be hung from said front and back pulls by vertically disposed pins attached to a rectangular frame. No means is provided for accommodating boots having side pull straps, or boots having differing length uppers. Jaekel, German Pat. No. 58,629, dated Sep. 7, 1891 discloses an apparatus that may be used to facilitate installation of boots having either front and rear pull straps, or side pull straps. Jaekel discloses a pair of cylindrical uprights. At the top of each upright is a single, fixed, arcuate shaped pin which curves inwardly and forward. Boots having side pulls may be suspended from the arcuate shaped pins and stepped into. For boots having front and rear pull straps a pair of pins is provided on a base which may be folded to a vertical position. Bisanz, U.S. Pat. No. 530,080, dated Dec. 4, 1894 discloses a bootjack having a plate which may be disposed horizontally or vertically. When the plate is disposed horizontally, a pair of pins projecting perpendicularly therefrom form legs supporting on end of the plate. When the plate is disposed vertically, the pins project horizontally and a boot having front and back pull straps may be hung therefrom and stepped into. No means is provided for accommodating boots having side pull straps, or boots having differing length uppers. Hansl, Austrian Pat. No. 587,629, dated Oct. 1, 1900 discloses an apparatus which appears to have a pair of ladder-like uprights and two sets of pins projecting, both forward and rearward, perpendicularly therefrom. The lower set of pins appears to be disposed upon a carriage mechanism, which may be slidably disposed along each upright. If slidably disposed then Hansl may accommodate boots of different length uppers.

Each of the aforesaid patents is either not directed towards accomplishing the functions of the invention herein disclosed, or represents a different, more complex or less desirable apparatus with which to accomplish said functions.

OBJECTS OF THE INVENTION

The general object of the invention disclosed and claimed herein are to provide an apparatus to aid a person to place boots having side pull straps onto their feet. It is to provide an apparatus whereby the user will be able to "step into" boots having side pulls and thereby be able to install (one at a time) boots onto the user's feet, without the necessity of bending over, grasping the pulling straps and manually pulling the boots onto their feet. It is to provide an apparatus which may be facilely adjusted to accommodate boots of various length uppers. It is to provide an apparatus which is strong, stable, has few parts, is easy to use, has few projections upon which pants, socks or boots may inadvertently "hang." It is to provide an apparatus from which boots do not easily slip off inadvertently yet from which the booted foot may be facilely removed after the boot is in place on the foot. It is to provide an apparatus which does not have excessive space requirements and is not unattractive in appearance.

SUMMARY OF THE INVENTION

The wide horizontal base provides the invention a secure and stable means for attachment of uprights. Rigidly attached to the base is a pair of vertically disposed uprights. Each upright has a plurality of openings disposed at differing heights. Each opening extends longitudinally in a direction which is generally horizontal and perpendicular to a line between the uprights. A pin is removably disposed in each upright in an opening which is a height commensurate with the upper of the boots to be installed on the user's foot. A portion of the length of each pin extends a distance from each opening towards the heel of the user. The outward end of each pin has an upwardly sloping portion. Means are provided so that a pin will not rotate about its longitudinal axis when installed in an opening. A bolt, cross-pin pin, clip or other device may be used to prevent the pin from being unintentionally pulled longitudinally from the opening during use.

The side straps of a pull-on boot may be hung, by said straps, from said pins, and then "stepped" into. The upwardly sloping portion of each pin will prevent the boot from slipping off of the pins in response to downward pressure on the boot. Yet the booted foot may be easily disconnected from the invention by flexing the leg at the knee (lifting the foot upward and backwards, in the natural direction of flexion of the knee).

DESCRIPTION OF THE PREFERRED EMBODIMENT

Figure 1:
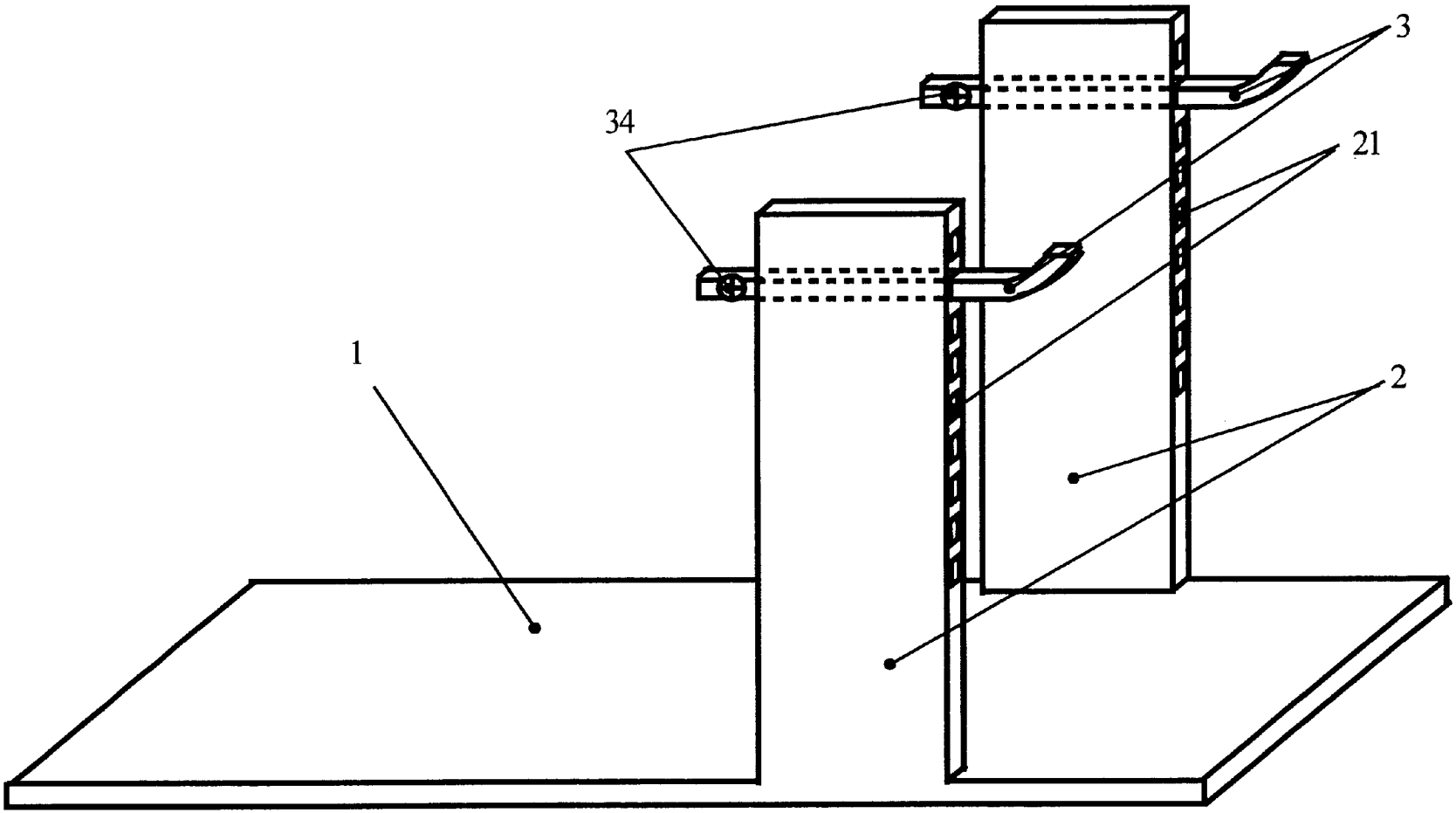
FIG. 1 is an isometric view of an embodiment of the invention from a side and rear perspective.
Figure 2:
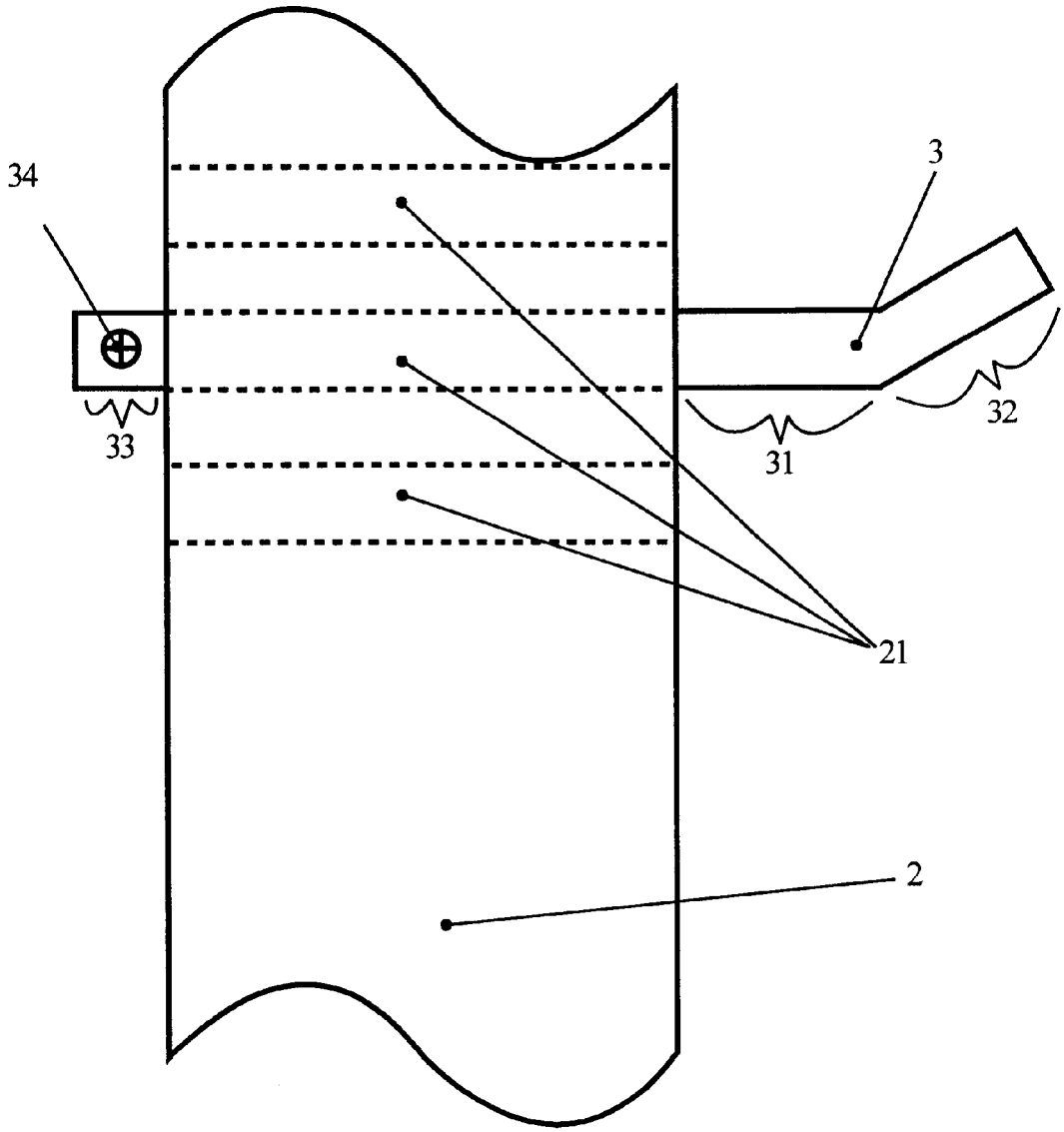
FIG. 2 is a more detailed, side view of a section of a portion of an upright of the invention with a pin disposed in one of the holes of said upright.
Figure 3:
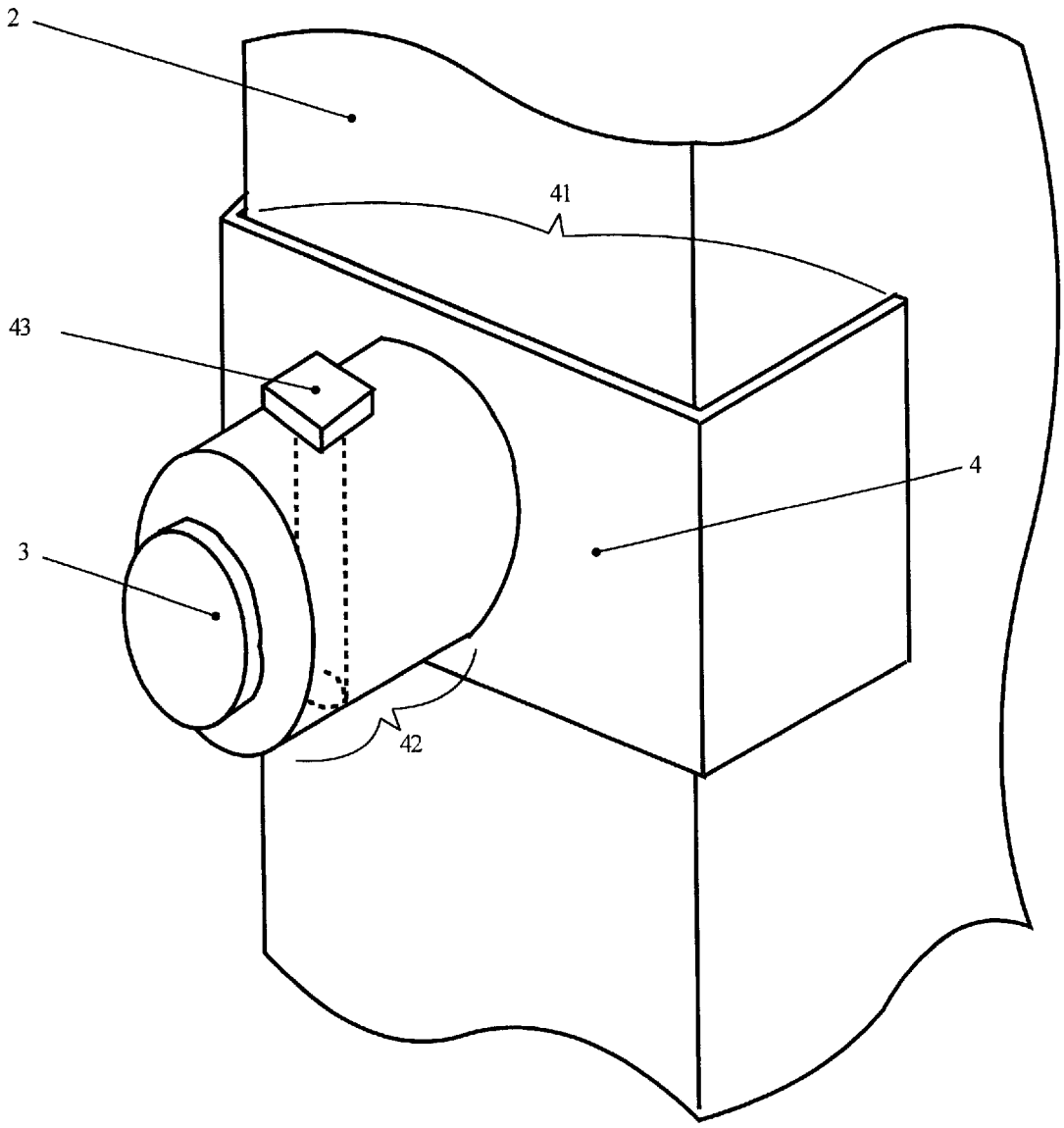
FIG. 3 is a more detailed isometric view of the locking clip of the preferred embodiment of the invention in place on a pin of circular cross-section.

While the present invention will be described with reference to preferred embodiments, it will be understood by those skilled in the art that various changes may be made and equivalents may be substituted for elements thereof without departing from the scope of the invention. In addition, modifications may be made to adapt a particular situation or material to the teachings of the invention without departing from the essential scope thereof. It is therefore intended that the present invention not be limited to the particular embodiments disclosed herein, but that the invention will include all embodiments (and legal equivalents thereof) falling within the scope of the appended claims.

The preferred embodiment is provided with base plate 1, which is intended to rest horizontally on the surface of a floor of a building or the like when the invention is used. In the preferred embodiment base plate 1 will have a longitudinal axis which will run in the direction of the foot portion of the boots that the invention is to be used with, and a transverse axis running perpendicular thereto. In preference, base plate 1 will be made of a strong, rigid, heavy material such as steel, cast metals or heavy woods. However, ceramics, hydrocarbon resins ("plastics") or other strong structural materials may be used. Provision may be made to secure base plate 1 to the floor of a building if desired, as by screws, bolts, clips, and the like.

In the preferred embodiment the bottom of base plate 1 will be a substantially flat surface which rests evenly upon a substantial flat floor of a building or the like. The bottom of base plate 1 may be covered with rubber, cork, felt or other material so that it does not scratch the floor of a structure upon which it may rest and/or has less tendency to slide thereon. The bottom edges of base plate 1 may also be equipped with short legs, which may be of adjustable length, to compensate for some unevenness of the floor of the building upon which it rests, make it more stable on a carpeted surface, and/or for decorative purposes.

The top of base plate 1 may be a substantially flat, horizontal surface engraved, sculptured, overlaid with decorative material or painted, so long as its surface features do not prevent the sole of a boot from resting substantially horizontal thereon. As to the shape of base plate 1 (as viewed from a vertical perspective), the preferred shapes are either rectangular or oval, but base plate 1 may be any shape which provides substantial longitudinal and lateral stability against tipping over in response to torque forces in a vertical plane.

Attached to base plate 1 are a pair of uprights 2, which are spaced apart along a line parallel to the traverse axis of base plate 1. In the preferred embodiment of the invention, uprights 2 will be disposed substantially perpendicular to base plate 1. The length of uprights 2 will be at least as long as the longest uppers (leg portions) of boots that the invention is to be used with. In the preferred embodiment of the invention, uprights 2 will be spaced apart a distance which is at least as wide as the width of the foot portion of the widest boot that the invention is to be used with, and will in practice be somewhat wider than that so that there remains some lateral space between the booted leg of the user and the uprights after using the invention to install a boot. This distance may vary according to the size of the user and the length of boots to be installed. It has, however, been found that a distance of about 7 inches will accommodate most users to install boots of up to calf length. Also comprehended by the invention are uprights which are inclined outwardly from the longitude of base plate 1 (are spaced wider apart at their top than their bottom).

In either of the aforesaid embodiments each upright 2 is equipped with a set of holes 21. Each hole 21 runs in a direction which is substantially parallel to the longitude of base plate 1. With respect to an individual upright, each hole is disposed a different distance from base plate 1, thereby forming an array of holes running parallel to the longitude of base plate 1 at differing heights on said upright. For each hole on one upright, the other upright will have a hole at or near that same height.

The cross-sectional shape of the holes 21 may vary, depending on the pins 3 (which will be discussed further hereinafter) to be installed therein. As will be seen, the holes 21 may have a "keyed" cross-sectional shape (whereby a pin of mating cross-sectional shape inserted in said hole would not be rotatable about the longitude of the pin) or an "un-keyed" cross-sectional shape (whereby a pin of mating cross-sectional shape would, unless otherwise restrained, be rotatable about the longitudinal axis of the pin). For purposes of the invention disclosed herein either is comprehended.

Next, the invention includes a pair of pins 3, one of which is intended to be installed in a selected hole 21 of each upright 2, have a portion which projects a distance 31 "backward" (towards the heel of the boot) parallel to the longitude of base plate 1 which is sufficiently long to accommodate the pulls of boots that the invention is to be used with and at the end of said pin has a portion 32 which bends upwardly. Said pins 3 may also have a portion 33 which extends through hole 21 and a distance beyond the opposite side of upright 2. Portion 31 provides a space upon which to place the pull of a boot, thereby suspending the boot generally vertically from the invention. Portion 33, if provided, provides an area where a cross-pin 34 or other structure may be placed to prevent pin 3 from inadvertently being pulled out from hole 21 when the invention is in use. The purpose of the upward bend 32 is to restrain the pulls from inadvertently slipping off of portion 31 of the pin 3 while trying to slip the foot into a boot suspended from the pins by its pulls. As such attempt will involve application of downward forces with the foot, the upwardly inclined portion 32 of pin 3 will tend to slide the pulls of the boot more onto portion 31 of pin 3, rather than "off of" said pin. Yet, after placement of the foot into the boot, the now booted foot remains easy to disconnect from the invention by simply moving the foot slightly upwards and backwards (which may be easily accomplished by flexing the knee slightly in its natural direction).

It is however relevant to the above described functions of the invention herein disclosed that pin 3 not be able to rotate about its axis and thereby turn portion 32 downward during use. This may be accomplished by various means, each of which is equally preferred. For example, holes 21 may be a cross-sectional shape which is "keyed" (in the sense that a pin of mating cross-sectional shape will not be rotatable about its axis when in said hole). Such keyed holes and pins may be of oblong, square, rectangular, other polygonal shape or may be circular (or any other shape) and equipped with longitudinally disposed key. In such case it will not be necessary to provide separate means to restrain pin 3 from rotating about its axis when installed in hole 21. It may, however, nevertheless remain desirable to provide means to prevent pin 3 from being inadvertently pulled longitudinally from hole 21. Accordingly, a cross-pin 34, or some other means of longitudinal restraint is comprehended by the invention herein disclosed.

Also preferred is a hole 21 and pin 3 which are of circular cross-sectional shape, particularly as it is typically easier to drill circular holes, as with a spiral drill bit, than holes of other cross-sectional shapes. However, when a circular hole and pin arrangement is used, means is provided to restrain the pin from rotating about its longitude within said hole. This might be done by cross-pin through upright 2 and pin 3. Such cross-pinning, while comprehended by the invention, presents manufacturing considerations. As the invention envisions the possibility that pin 3 might be installed in any of holes 21, a hole for such cross-pin would have to be drilled for each of holes 21. Accordingly, particularly preferred is restraining both longitudinal and rotatable movement of circular shaped pin and hole by another means, that is restraint clip 4. Said restraint clip has a section 41 which engages the sides of upright 2 and a second section 42 which slips over the end 33 of pin 3. A cross-pin 43 engages section 42 with pin 3, thereby securing pin 3 from both longitudinal and rotatable movement in hole 21. While other dispositions are possible it is preferred that pin 43 be installed vertically and have a flared end 44 which faces upward. Thus disposed the weight of pin 43 tends to maintain it in place.

The invention is easy to use. The height of pins 3 for a boot of a particular length upper is established by moving pins 3 to holes 21 of appropriate height. Each pull strap of the boot is then hung from a pin 3 of each upright. The user then places his/her foot through the top of the upper and exerts downward pressure with his/her foot and leg until the boot is fully seated on the foot. Following seating of a boot the pull straps of the boot may be easily removed from pins 3 by simply moving the now booted foot upward and backward (toward the heel). Placement of the other boot on the other foot follows the same procedure.

It is thus to be appreciated that a process established in accordance with the principles and teachings of the present inventive disclosure constitutes an advancement in the field of art to which the invention pertains. While the above description contains many specificities, these should not be construed as limitations on the scope of the invention, but rather as an exemplification of preferred embodiments thereof. Accordingly, the scope of the present invention should be determined not by the embodiments illustrated, but by the appended claims and their legal equivalents.

What is claimed is:

1. An apparatus to aid the user thereof to install a boot having a toe, a heel and a leg portion having side pull straps onto the feet of the user, comprising:

a) a generally horizontal base plate having a front thereof which is contiguous with the toe of said boot, a rear thereof which is contiguous with the heel of said boot, a longitude therebetween and a width running traverse to said longitude;

b) a first upright extending upwardly from said base plate from a first point, where said first point is on a line which is parallel to the width of the base plate;

c) a second upright extending upwardly from said base plate from a second point on said line which is spaced apart from said first point;

d) a first set of holes, disposed along said first upright, each of which said holes extends in a direction which is parallel to the longitude of the base plate and is at a height above said base plate which is different than the height of other holes in said first set;

e) a second set of holes, disposed along said second upright, each of which said holes extends in a direction which is parallel to the longitude of the base plate and is at a height of a hole in said first set of holes;

f) a first pin removably disposed in a selected hole of said first set of holes, wherein said pin extends a distance therefrom in a direction which is parallel to the longitude of the base plate and towards the rear thereof and terminates with an upwardly inclined section;

g) a second pin removably disposed in a selected hole of said second set of holes, wherein said pin extends a distance therefrom in a direction which is parallel to the longitude of the base plate and towards the rear thereof and terminates with an upwardly inclined section; and, h) wherein the cross-sectional shape of said first and second holes and said first and second pins is a polygon.

2. An apparatus to aid the user thereof to install a boot having a toe, a heel and a leg portion having side pull straps onto the feet of the user, comprising:

a) a generally horizontal base plate having a front thereof which is contiguous with the toe of said boot, a rear thereof which is contiguous with the heel of said boot, a longitude therebetween and a width running traverse to said longitude;

b) a first upright extending upwardly from said base plate from a first point, where said first point is on a line which is parallel to the width of the base plate;

c) a second upright extending upwardly from said base plate from a second point on said line which is spaced apart from said first point;

d) a first set of holes, disposed along said first upright, each of which said holes extends in a direction which is parallel to the longitude of the base plate and is at a height above said base plate which is different than the height of other holes in said first set;

e) a second set of holes, disposed along said second upright, each of which said holes extends in a direction which is parallel to the longitude of the base plate and is at a height of a hole in said first set of holes;

f) a first pin removably disposed in a selected hole of said first set of holes, wherein said pin extends a distance therefrom in a direction which is parallel to the longitude of the base plate and towards the rear thereof and terminates with an upwardly inclined section;

g) a second pin removably disposed in a selected hole of said second set of holes, wherein said pin extends a distance therefrom in a direction which is parallel to the longitude of the base plate and towards the rear thereof and terminates with an upwardly inclined section; and, h) wherein the cross-sectional shape of said first and second holes and said first and second pins is a circle.

3. The apparatus of claim 1 wherein said each of said first and second pins are secured against movement in a selected hole by a cross-pin.

4. The apparatus of claim 2 wherein said each of said first and second pins are secured against movement in a selected hole by a cross-pin.

5. The apparatus of claim 1, wherein said each of said first and second pins are secured against movement within a selected hole of an upright by an interlock comprising a first portion which is non-rotatably engageable with the exterior of said upright and a second portion which is non-rotatably engageable with a portion of a pin extending through a side of the upright which is opposite to the upwardly inclined portion of said pin.

6. The apparatus of claim 2 wherein said each of said first and second pins are secured against movement within a selected hole of an upright by an interlock comprising a first portion which is non-rotatably engageable with the exterior of said upright and a second portion which is non-rotatably engageable with a portion of a pin extending through a side of the upright which is opposite to the upwardly inclined portion of said pin.

7. The apparatus of claim 1 wherein the first and second uprights extend upwardly from said base plate in a direction which is substantially perpendicular to said base plate.

8. The apparatus of claim 2, wherein the first and second uprights extend upwardly from said base plate in a direction which is substantially perpendicular to said base plate.

9. The apparatus of claim 1, wherein the first and second uprights extend upwardly from said base plate in a direction which is substantially perpendicular to said base plate.

10. The apparatus of claim 2, wherein the first and second uprights extend upwardly from said base plate in a direction which is substantially perpendicular to said base plate.

11. The apparatus of claim 1, wherein the first and second uprights extend upwardly from said base plate in a direction which is inclined outwardly from the longitude of said base plate.

12. The apparatus of claim 2, wherein the first and second uprights extend upwardly from said base plate in a direction which is inclined outwardly from the longitude of said base plate.

13. The apparatus of claim 11, wherein the first portion of said interlock is comprised of a "U" shaped structure which has an opening which is slightly larger than the distance between the outer surfaces of an upright in a plane traverse to the longitude of the upright and to the longitude of the pin to be engaged.

14. The apparatus of claim 12, wherein the first portion of said interlock is comprised of a "U" shaped structure which has an opening which is slightly larger than the distance between the outer surfaces of an upright in a plane traverse to the longitude of the upright and to the longitude of the pin to be engaged.

15. The apparatus of claim 11 wherein the second portion of said interlock includes a first hole having a longitudinal axis contiguous with the longitudinal axis of the pin to be engaged, a second hole running traverse thereto and a cross-pin extending through said second hole and into the pin to be engaged.

16. The apparatus of claim 12 wherein the second portion of said interlock includes a first hole having a longitudinal axis contiguous with the longitudinal axis of the pin to be engaged, a second hole running traverse thereto and a cross-pin extending through said second hole and into the pin to be engaged.

* * * * *